US010501918B2

(12) United States Patent
Jeon et al.

(10) Patent No.: US 10,501,918 B2
(45) **Date of Patent: *Dec. 10, 2019**

(54) WASHSTAND CABINET

(71) Applicant: LG ELECTRONICS INC., Seoul (KR)

(72) Inventors: Jinhyeon Jeon, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/783,122

(22) Filed: Oct. 13, 2017

(65) Prior Publication Data

US 2018/0106026 A1 Apr. 19, 2018

(30) Foreign Application Priority Data

Oct. 14, 2016 (KR) ..... 10-2016-0133441

(51) Int. Cl.

| | |
|---|---|
| ***E03C 1/326*** | (2006.01) |
| ***A47K 10/48*** | (2006.01) |
| ***E03C 1/04*** | (2006.01) |
| ***E03C 1/182*** | (2006.01) |
| ***F24F 5/00*** | (2006.01) |
| ***F24F 13/14*** | (2006.01) |
| ***F24F 13/28*** | (2006.01) |
| ***F26B 21/00*** | (2006.01) |

(52) U.S. Cl.

CPC ..... *E03C 1/326* (2013.01); *A47K 10/48* (2013.01); *E03C 1/04* (2013.01); *E03C 1/182* (2013.01); *F24F 5/0096* (2013.01); *F24F 13/14* (2013.01); *F24F 13/28* (2013.01); *F26B 21/001* (2013.01); *F26B 21/003* (2013.01); *F26B 21/004* (2013.01); *E03C 2201/90* (2013.01); *F24F 2013/1433* (2013.01); *F24F 2221/10* (2013.01); *F24F 2221/18* (2013.01); *F24F 2221/34* (2013.01)

(58) Field of Classification Search

CPC . E03C 1/326; E03C 1/04; E03C 1/182; A47K 10/48; F24F 5/0096; F24F 13/14; F24F 13/28; F26B 21/003; F26B 21/004

USPC ..... 4/630

See application file for complete search history.

(56) References Cited

U.S. PATENT DOCUMENTS 2,920,463 A * 1/1960 Gould ..... F25B 39/00 165/136
3,035,418 A * 5/1962 Wright ..... E03B 3/28 62/176.1
3,225,559 A * 12/1965 Fischer ..... F25D 23/126 62/180

(Continued)

FOREIGN PATENT DOCUMENTS

EP 3124887 A1 * 2/2017 ..... F24F 13/14
KR 20-2013-0003854 6/2013

*Primary Examiner* — Tuan N Nguyen
(74) *Attorney, Agent, or Firm* — Ked & Associates, LLP

(57) ABSTRACT

Disclosed is a washstand cabinet. The washstand cabinet includes a washstand having a water supply valve and a washing bowl in which water is accommodated, a housing provided under the washstand to define an external shape thereof and having a modular space therein, and an air-conditioning module configured to discharge air outward from the housing or to move air into the modular space inside the housing.

16 Claims, 12 Drawing Sheets

(56) References Cited

U.S. PATENT DOCUMENTS

| | | | | |
|---|---|---|---|---|
| 5,727,579 | A * | 3/1998 | Chardack | A47K 10/485 134/102.3 |
| 2012/0210509 | A1* | 8/2012 | Dehn | B64D 11/02 4/638 |
| 2014/0273805 | A1* | 9/2014 | Yasutomi | F24F 13/14 454/322 |
| 2015/0059085 | A1* | 3/2015 | Seibt | A47K 10/48 4/638 |
| 2015/0354874 | A1* | 12/2015 | Cur | F24F 1/0007 62/216 |

* cited by examiner

WASHSTAND CABINET

CROSS-REFERENCE TO RELATED APPLICATION

This application claims priority under 35 U.S.C. § 119 to Korean Application No. 10-2016-0133441, filed on Oct. 14, 2016, whose entire disclosure is hereby incorporated by reference.

BACKGROUND

1. Field

The present disclosure relates to a washstand cabinet provided under a washstand, and more particularly, to a washstand cabinet including an air drying module.

2. Background

A bathroom may have a relatively limited storage space for organizing bathroom articles, and an upper cabinet (also commonly referred to as a medicine cabinet) may be installed on a bathroom wall to provide additional space for organizing bathroom articles. The upper cabinet may be configured such that an accommodating space is formed within a main body, and a door having a mirror may be installed on the main body to enable the storage of bathroom articles in the accommodating space through the opened door.

In order to promote the utilization of a lower space in a bathroom under the upper cabinet, Korean Patent Application No. 20-2011-0011271 (published as KR 20-2013-0003854 on Jun. 28, 2013) teaches a lower cabinet that includes a modular storage space defined under a washstand. For example, a laundry basket may be accommodated in the storage space. However, this and other conventional bathroom cabinets do not include a separate device for providing a flow of air that may be used, for example, to remove water from a damp bathroom surface or a user or is circulated inside a washstand cabinet. The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Hereinafter, a washstand cabinet (also commonly known as a vanity) including an air-conditioning module (or dryer) according to embodiments of the present disclosure will be described with reference to the accompanying drawings.

Figure 1:
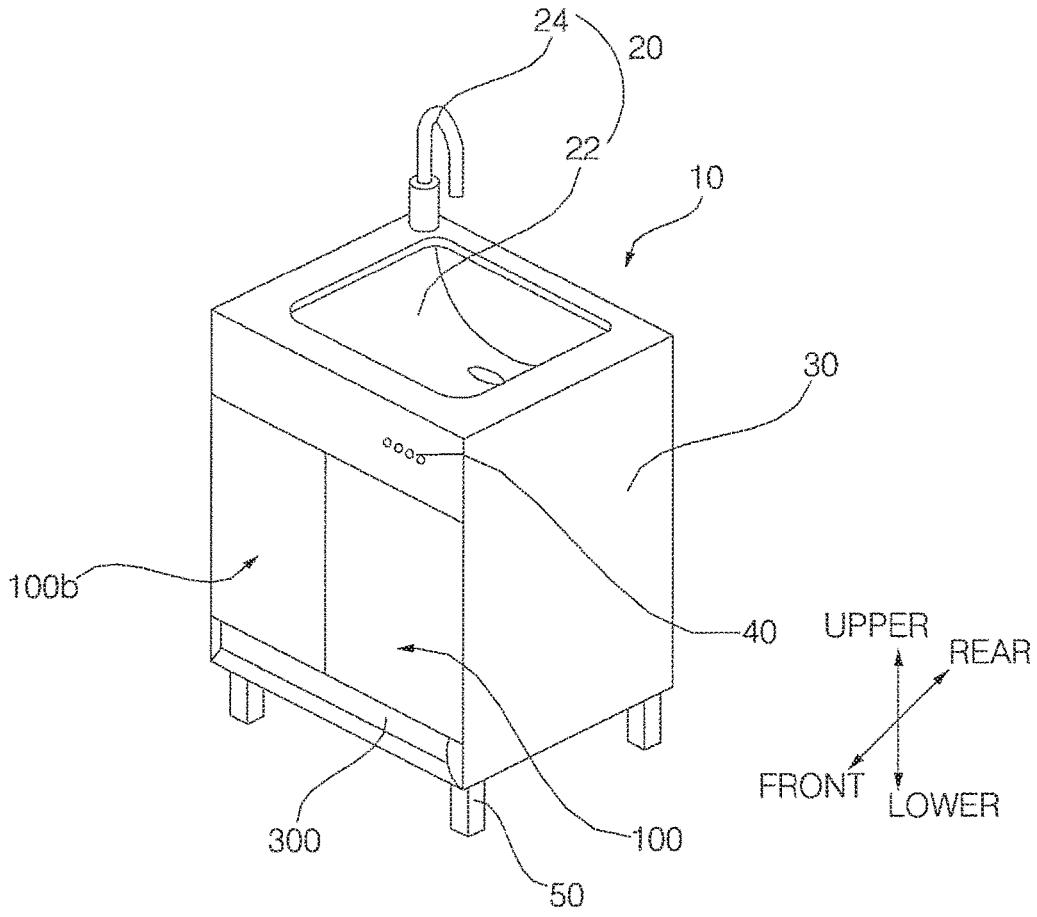
FIG. 1 is a perspective view illustrating a washstand cabinet according to an embodiment of the present disclosure.

Referring to FIG. 1, a washstand cabinet 10 according to one embodiment may include a washstand 20 having a water supply valve (or faucet) 24 and a washing bowl (or basin) 22 in which water may be accommodated. The washstand cabinet 10 may further include a housing 30 provided under the washstand 20 to define the external shape thereof and that may have a modular internal space, and an air-conditioning module (or dryer) 300 that may discharge air outward from the housing 30 or may move air to the modular internal space within the housing 30.

The washstand 20 may be a fixture that is provided at a wall or other region of a bathroom and is configured to enable a user to wash his/her hands or face. The water supply valve 24 may be provided on the upper end of the washstand 20. The washing bowl 22 may be concavely formed in a central portion of the washstand 20 to accommodate water therein. In addition, the washstand 20 may be is connected to a drain pipe (not illustrated) that drains the water accommodated in the washing bowl 22.

The washing bowl 22 may be formed, for example, as an enameled basin or an earthenware basin. In other examples, the washing bowl 22 may be provided in various different forms and materials. The washing bowl 22 may be the enameled basin, for example, so that the housing 30 may be easily coupled to the bottom of the washing bowl 22.

The housing 30 may be located under the washstand 20. The housing 30 may define an external shape at a periphery and bottom of the washstand cabinet 10. The top of the housing 30 may be connected to the washing bowl 22. In one example, the housing 30 may have an open top to receive the washing bowel 22. In order to prevent water used in a bathroom from entering the interior of the housing 30, a seal may be provided at a portion of the washing bowl 22 connected to or contacting the housing 30.

Cabinet legs 50 may be provided at a bottom of the housing 30 for spacing the washstand cabinet 10 apart from the floor of the bathroom by a given distance. However, the cabinet legs 50 may be omitted according to, for example, a use purpose of the washstand cabinet 10 and/or the desired space inside the washstand cabinet 10. When the cabinet legs are omitted, the bottom of the housing 30 may be positioned to directly contact the floor of the bathroom. In this configuration, the bottom of the housing 30 may be sealed along the floor of the bathroom in order to prevent water in the bathroom from entering the interior of the housing 30.

Figure 4:
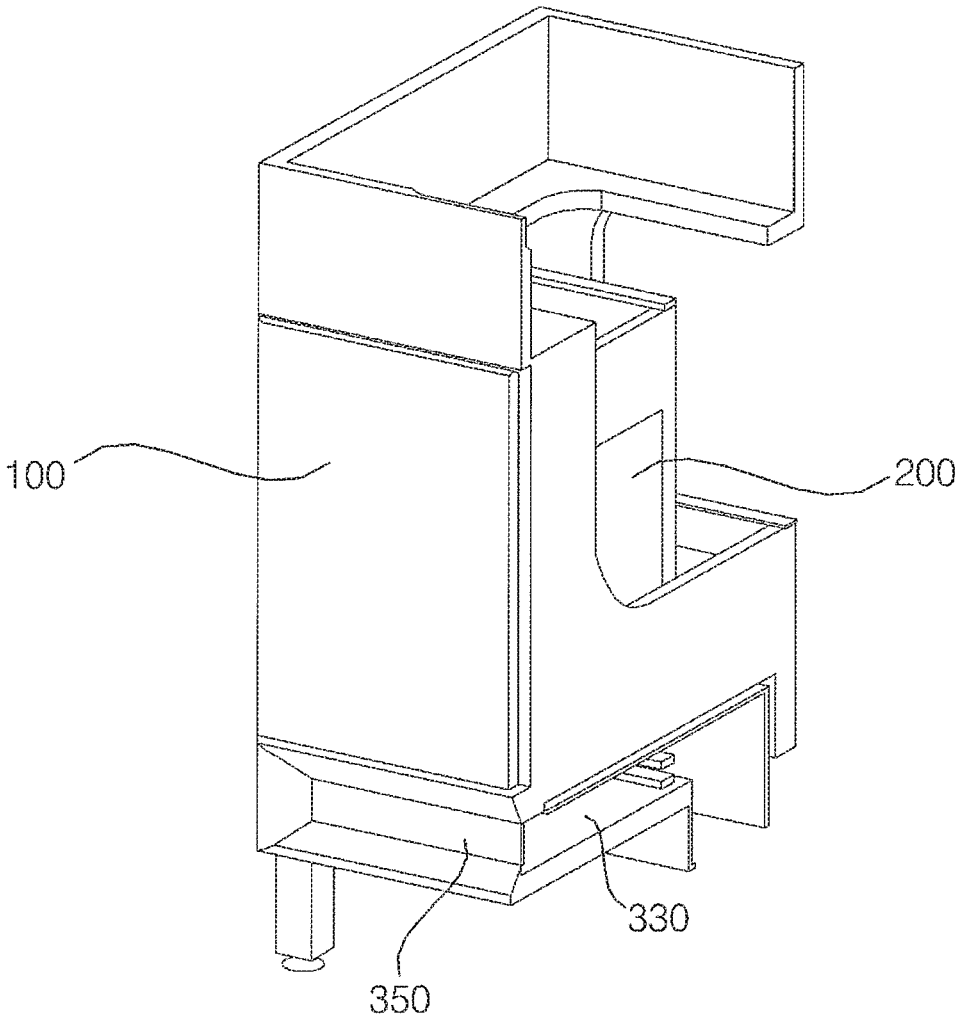
FIG. 4 is a partially cut-away cross-sectional and perspective view of the washstand cabinet including the air-conditioning module according to the embodiment of the present disclosure.

One or more modules 200 may be provided inside the housing 30 (see FIG. 4). The module 200 provided inside the housing 30 may include an electronic device that is used in the bathroom. The module 200 may have a standardized exterior shape. As described below, various different types of the module 200 may be included in the housing 30 to perform various functions or to provide different storage capabilities.

Various arrangements of modules 200 inside the housing 30 will be described. As illustrated in portion (a) of FIG. 3, an upper region of the housing 30 may include two modules A and B provided at a front side thereof and another module C provided at a rear side thereof. In one example, the pipe that drains the water from the washstand 20 may be provided in the space of the module C at the rear side. In addition, a flat, plate-shaped module D may also be provided in the lower region of the housing 30. As described below, the module D may be the air-conditioning module 300 for outputting a flow of air to dry the bathroom or a user. For instance, the air-conditioning module 300 may suction air from the bottom of the housing 30 and discharge the air forward (e.g., away from a bathroom wall wherein the housing 30 is positioned).

Figure 3:
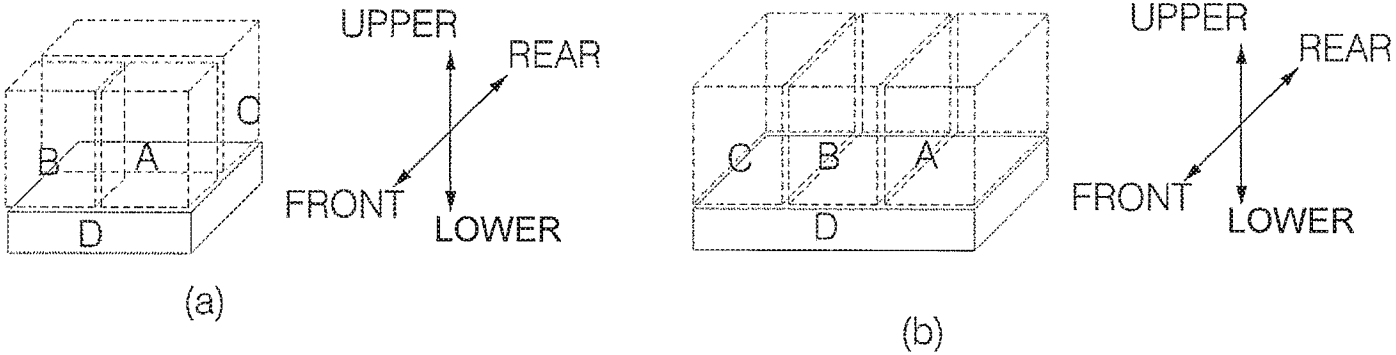
FIG. 3 are views illustrating the arrangement relationship between modules and an air-conditioning module according to embodiments of the present disclosure.

In another example illustrated in portion (b) of FIG. 3, three modules A, B and C may be arranged side-by-side in the upper region and a flat, plate-shaped module D may be provided in the lower region. As previously described, the module D in portion (b) of FIG. 3 may be the air-conditioning module 300 for drying the bathroom or the user.

It should be appreciated that the particular arrangements of the modules 200 illustrated in the FIG. 3 or other figures are given as examples, and the modules 200 may be arranged in various ways in consideration of, for example, the number, position, and size of the modules 200, and/or the size and functionality of the housing 20.

Figure 2:
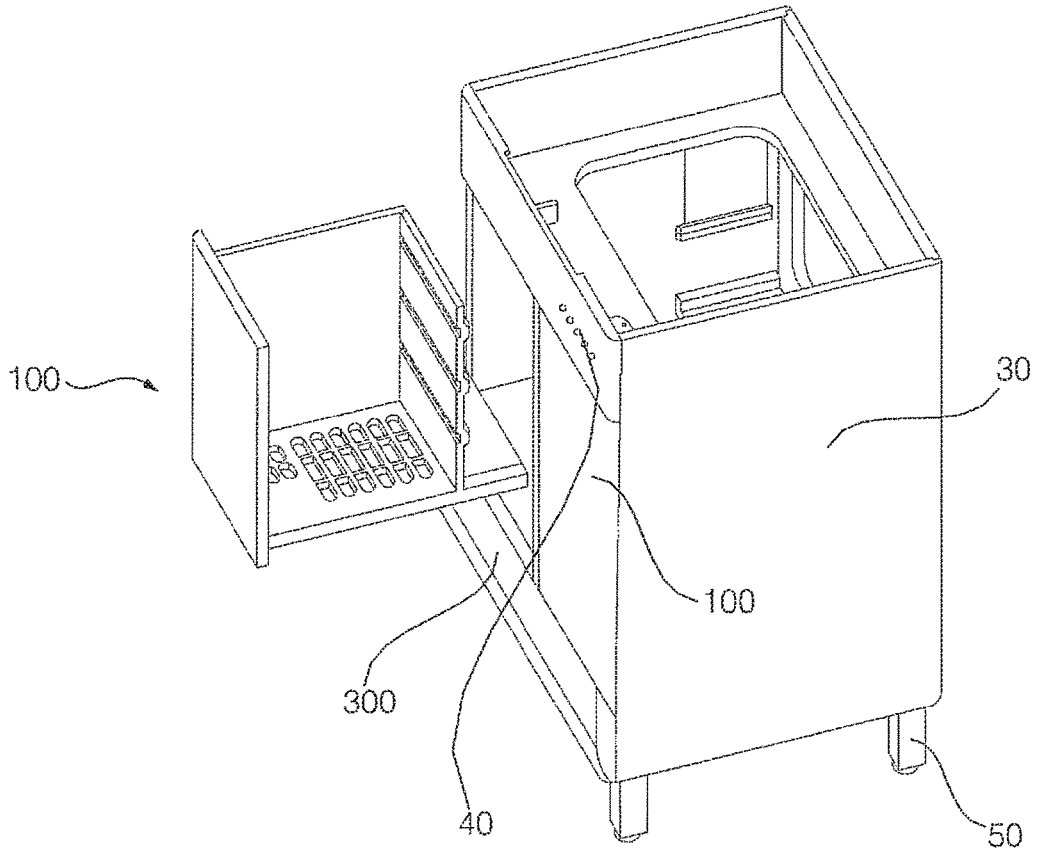
FIG. 2 is a perspective view of a housing in the state in which one module case is pulled outward according to the embodiment of the present disclosure.

A module case 100 may be provided in the washstand cabinet 10 to divide the space inside the housing 30 into two or more spaces and to accommodate one or more of the modules 200 therein, and the module case 100 may define a space in which the module 200 is stored. The module 200 may be separably coupled to an interior of the module case 100. The module case 100 may be provided inside the housing 30 so as to be pulled outward from the housing 30 (see FIG. 2). The module case 100 may have a size suitable for surrounding the exterior of the module 200 and may occupy a predetermined space inside the housing 30. The module case 100 may divide the space inside the housing 30 so as to accommodate one or more modules 200 therein. For example, in FIG. 1, a module case 100*b* may receive module B, as described with respect to FIG. 3.

An input unit (or user interface) 40 may be provided on the upper portion of the housing 30 and may be used to input a command to a controller (not shown), which is provided inside the washstand cabinet 10 to control the module 200. In an example, shown in FIG. 1, the input unit 40 may be formed on the upper portion of the housing 30 and immediately below the washstand 20 to be at a position at which the user may conveniently operate the input unit 40 in a standing posture.

The input unit 40 may include a button for receiving a control command related to an operation of the module 200 or the air-conditioning module 300 of the washstand cabinet 10 from the user (e.g., by a user contact of the button). In addition, the input unit 40 may include or be associated with a display (not illustrated), such as an liquid crystal display (LCD) or a display with light emitting diodes (LEDs) may be provided to visually display information related to the operating state. For example, the input unit 40 may be formed as a touch panel to simultaneously receive a user input and to display information to the user.

The controller (not illustrated) may be provided on the rear surface of the input unit 40 inside the housing 30 to recognize and may control one or more of the modules 200. For example, the controller may forward control signals to control the air-conditioning module 300 provided in the lower region of the housing 30, and may be connected to the input unit 40 to control an input user command. For example, the controller may selectively activate the air-conditioning module 300 based on a user input received via the input unit 40. In another example, the controller may be connected to a sensor (not shown), such as a moisture sensor, a user promiity sensor, a temperature sensor, etc., and the controller may selectively activate the air-conditioning module 300 based on information collected by the sensor, such as to activate the air-conditioning module 300 when detected air moisture levels exceed a threshold level.

The air-conditioning module 300 according to one embodiment may be a device that removes moisture in the air in the bathroom. The dried air may be discharged by the air-conditioning module 300 toward a surface of the bathroom floor or the user or may be internally circulated. The air-conditioning module 300 may be provided in the lower region of the housing 30 that is close to the floor, for example, as a flow of dried air to dry the floor surface. However, this lower positioning of the air-conditioning module 300 is merely given by way of example, and the air-conditioning module 300 may be provided in the upper region of the housing 30 or on the side surface thereof (e.g., as one of modules A-C in FIG. 3).

Figure 5:
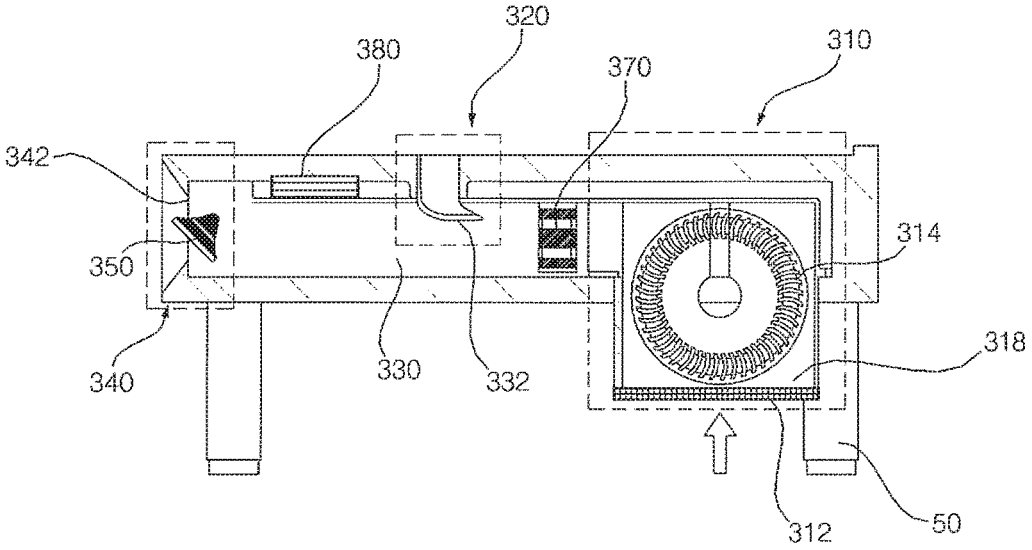
FIG. 5 is a cross-sectional view of the air-conditioning module according to the embodiment of the present disclosure.

Referring to FIG. 5, an air-conditioning module 300 according to one embodiment may include a suction portion (or suction end) 310 having a suction port 318 into which air is suctioned to enter the air-conditioning module 300, a discharge portion (or discharge end) 340 having a discharge port 342 from which the air inside the air-conditioning module 300 is discharged, and a vane (or cover) 350 that opens or closes the discharge port 342.

The suction portion 310 may be located in the rear of the air-conditioning module 300 (e.g., adjacent to a wall where the washstand cabinet 10 is installed) and may be provided with the suction port 318 that opens downward. A fan 314 may be provided in the suction portion 310 to suction air into the suction port 318. A filter 312 may be provided in the suction port 318 to remove particulates (e.g., dust) from the air introduced into the air-conditioning module 300.

In the embodiment shown in FIG. 5, the suction portion 310 may be provided with the downwardly opened suction port 318. However, this configuration is given as an example, and the suction port 318 (or an additional suction port 318) may be formed so as to be laterally opened through the provisioning of, for example, a sirocco fan such that the air is received at a vertical level corresponding to the installation height of the air-conditioning module 300. With the downwardly opened suction port 318 according to one embodiment, the air-conditioning module 300 may cause a movement of air from the bathroom floor under the washstand cabinet 10 to the downwardly opened suction port 318, thereby improving the drying of the bathroom floor due to air convection along the floor.

The filter 312 may be a device that removes particles (e.g., dust) in the air suctioned into the housing 30 and/or removes the air discharged from the discharge port. For example, the filter 312 may remove airborne particles to protect devices provided inside the air-conditioning module 300 from contamination by the particles. In one embodiment, the filter 312 may be provided in a space inside the air-conditioning module 300 into which air is suctioned (e.g., in a flow path from the suction port 318). In addition, the filter 312 may be further provided in the space for communication between the air-conditioning module 300 and another module 200. For example, the other module 200 may be provided above the air-conditioning module 300 (see, FIG. 4).

The discharge portion 340 may be located in the front section of the air-conditioning module 300 (e.g., positioned opposite the wall against which the washstand cabinet is installed). The discharge portion 340 may be provided with the discharge port 342 that is opened forward (e.g., toward a user). The vane (or cover) 350 may be installed in or adjacent to the discharge port 342 to adjust the direction in which air is discharged from the discharge portion 340. In one example, the vane 350 may control the direction of air discharged from the discharge port 342 such that the air is discharged upward or downward. For example, the vane 350 may rotate such that the air-conditioning module 300 may discharge air downward to dry the floor of the bathroom or may discharge air upward so as to dry the user or a higher portion of the bathroom space (e.g., a towel hanger).

Figure 7:
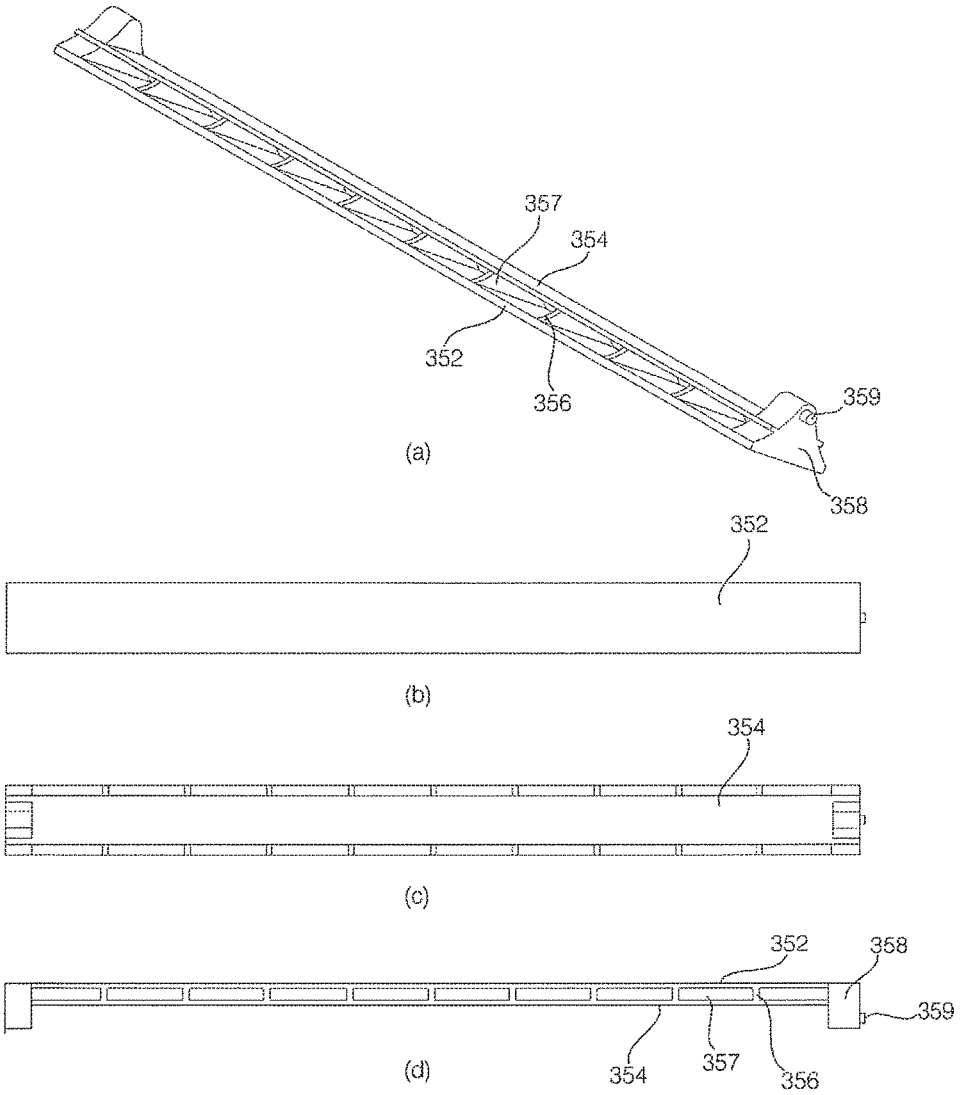
FIG. 7 shows perspective, front, rear, and plan views of the vane according to an embodiment of the present disclosure.

As shown in FIG. 7, the vane 350 may include a front vane (or front cover wall) 352, which may cover the discharge port 342 or may guide the direction in which air is discharged, a rear vane (or rear cover wall) 354, which may be rearwardly spaced apart from the front vane 352 and may be extend parallel to the front vane 352, and a plurality of connecting portions (or ribs) 356, which may connect the front vane 352 and the rear vane 354. The front vane 352 according to one embodiment may take the form of a plate that covers the discharge port 342. For example, the front vane 352 may have a rectangul or other shape that corresponds to a shape of the discharge port 342. The rear vane 354 may take the form of a plate that is smaller in surface area than the front vane 352. The rear vane 354 may be rearwardly spaced apart from the front vane 352 so as to extend substantially parallel to the front vane 352.

The connecting portions 356 may support the front vane 352 and the rear vane 354 so as to maintain a constant distance therebetween. Multiple connecting portions 356 may be formed between the front vane 352 and the rear vane 354. As such, a plurality of guide holes (or openings) 357 may be formed between the respective neighboring pairs of connecting portions 356 extending between the front vane 352 and the rear vane 354. The rear vane 354 and the connecting portions 356 may function as a structure that supports the front vane 352.

Side surface portions (or side surfaces) 358 may be provided on opposite lateral sides of the front vane 352 and the rear vane 354. The side surface portions 358 may be oriented perpendicular to the front vane 352 and the rear vane 354. The side surface portions 358 may be interconnected to the front vane 352 and the rear vane 354 and, in one implementation, may protrude rearward from the rear vane 354.

Each side surface portion 358 may be provided with a rotating shaft 359 that extends from a lateral end surface of the side surface portion 358, such that the vane 350 may rotate around the rotating shaft 359. For example, vane 350 may be attached at the rotating shaft 359 to a motor 360, described below. In one example shown in portion (d) of FIG. 7, the rotating shaft 359 may be located at portion of the side surface portions 358 near of the rear vane 354 and spaced away from the front vane 352. When the vane 350 rotates about the rotating shaft 359, the front vane 352 and the rear vane 354 may tilt together upward or downward, thereby changing the direction in which air is discharged from the air conditioning module 300.

Figure 6:
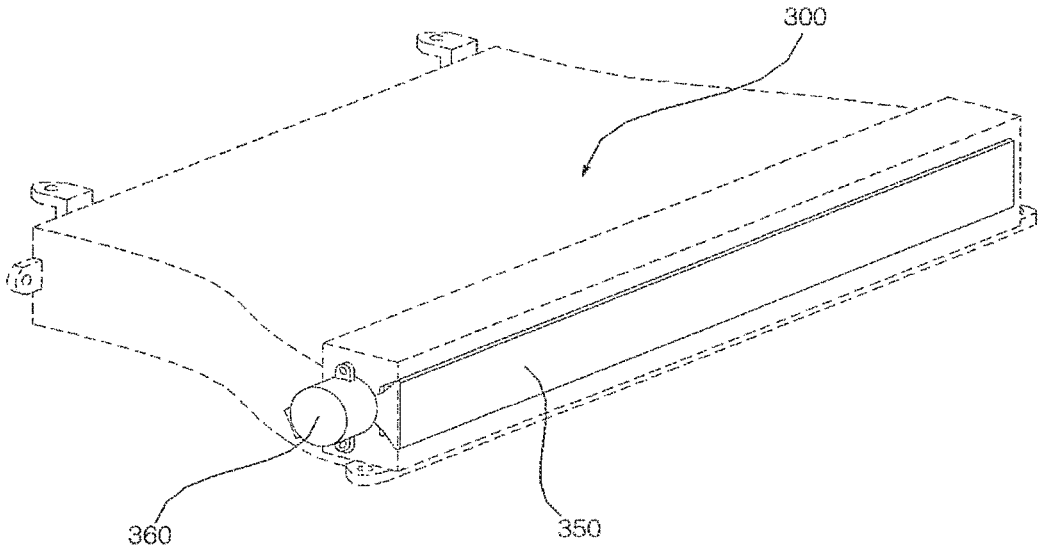
FIG. 6 is a view for explaining a vane of the air-conditioning module according to the embodiment of the present disclosure.

The motor 360 may be connected to one side of the side surface portion 358 (see FIG. 6). In the vane 350 according to one embodiment, the motor 360 may be connected to the rotating shaft 359 on the side surface portion 358. The orientation of the vane 350 may be changed due to the rotation of the motor 360 such that the rotation may be driven by the motor. The air-conditioning module 300 according to the present embodiment may adjust the direction in which air is discharged from the discharge port 342 by changing the orientation of the vane 350.

Figure 8:
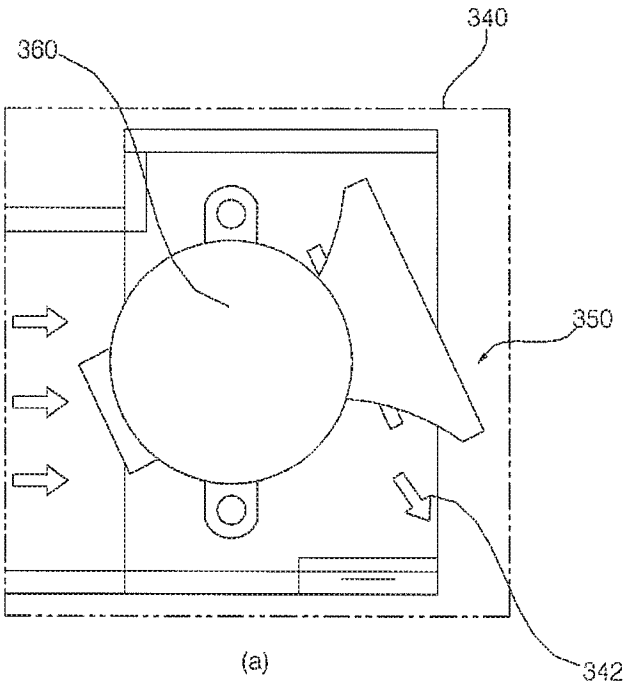
FIG. 8 shows respective views in which the bottom or the top of the vane of FIG. 7 is opened by a motor.
Figure 8:
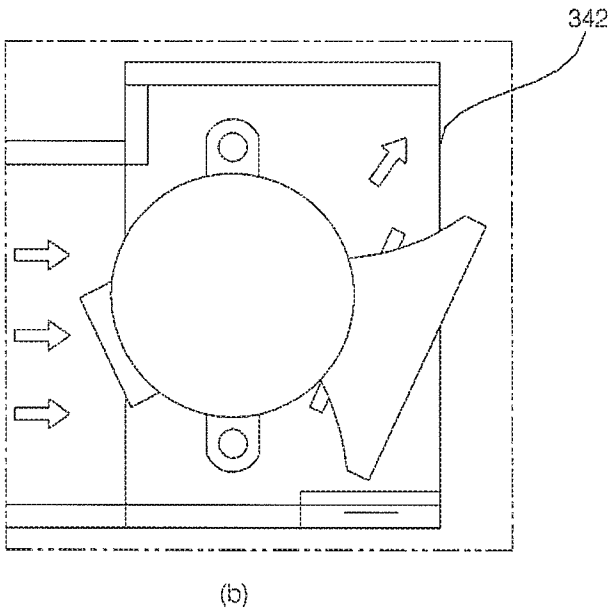

The flow of air from the discharge port 342 may change depending on the orientation of the vane 350, as will be described below with reference to FIG. 8, in which the vane 350 is shown is being positioned on a right edge of the output portion 340, and an entering air flow is shown as arrows on a left edge of the output portion 340. As illustrated in portion (a) of FIG. 8, when the motor 360 rotates counterclockwise, the vane 350 may rotate to expose a lower portion of the discharge port 342. When the air-conditioning module 300 operates while the lower portion of the discharge port 342 is opened, the air discharged from the air-conditioning module 300 may be directed downward, as represented by the downward arrows at right edge, such as to dry the floor of the bathroom. As illustrated in portion (b) of FIG. 8, when the motor 360 rotates clockwise, the vane 350 may rotate to expose an upper portion of the discharge port 342. When the air-conditioning module 300 operates while the upper portion of the discharge hole 342 is opened, the air discharged from the air-conditioning module 300 may be directed upward (as represented by the upward angled arrows at the right side) to dry a user or the space inside the bathroom.

Figure 9:
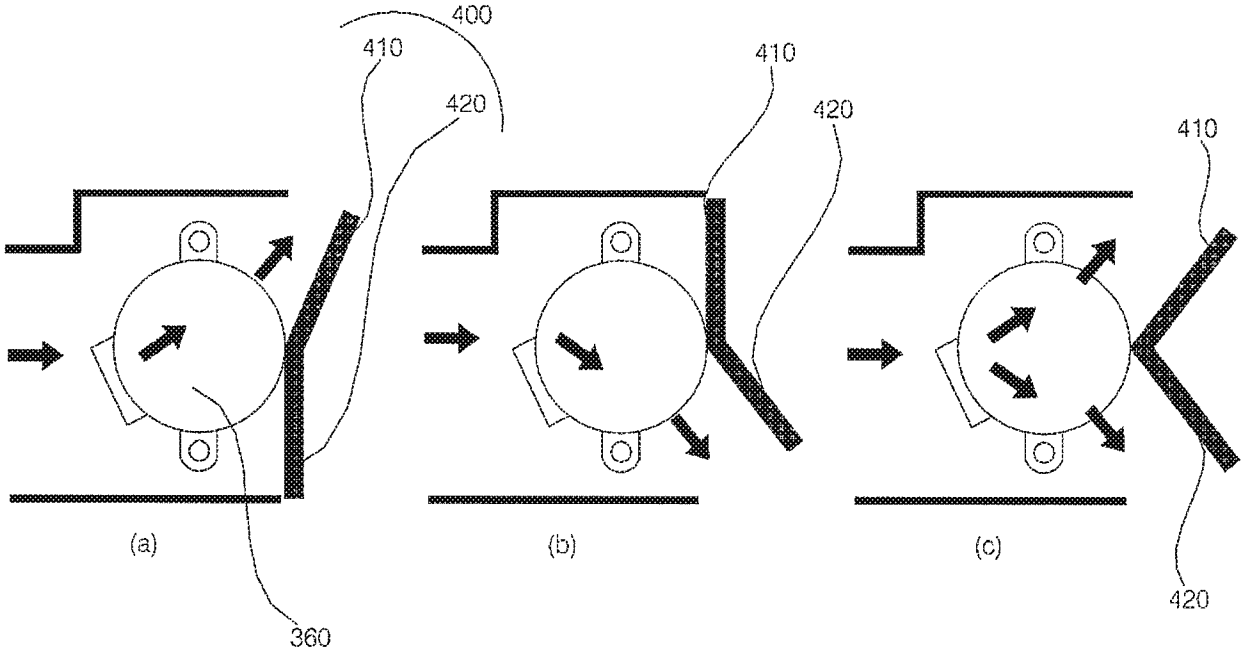
FIG. 9 shows respective views in which one of the top or the bottom, or both bottom and top of a vane, according to another embodiment of the present disclosure, are opened by the motor.

FIG. 9 is a view illustrating a vane 400 according to another embodiment of the present disclosure. Referring to FIG. 9, the vane 400 may include an upper vane (or upper cover) 410, which covers an upper side of the discharge port 342, and a lower vane (or lower cover) 420, which covers a lower side of the discharge port 342. The upper vane 410 and the lower vane 420 may be bendable relative to each other about a connection portion thereof (e.g., central end portions of the upper vane 410 and the lower vane 420 may be coupled) to enable the simultaneously discharge of air from the upper side and the lower side of the discharge port 342.

The vane 400 according to the embodiment illustrated in FIG. 9 may discharge air upward from the discharge port 342 when the motor 360 moves the upper vane 410, as illustrated in portion (a), to exposed a top portion of the discharge port 342. The vane 400 may discharge air downward from the discharge port 342 when the motor 360 moves the lower vane 420, as illustrated in portion (b, to exposed a lower portion of the discharge port 342). In addition, as illustrated in portion (c), the vane 400 may simultaneously discharge air upward and downward from the discharge port 342 when the motor 360 moves both the upper vane 410 and the lower vane 420 to exposed both the top and lower portions of the discharge port 342.

Referring to FIG. 5, a connection flow path 330 may be formed between the suction portion 310 and the discharge portion 340 of the air-conditioning module 300. A heater 370 that heats and dries the air may be provided in the connection flow path 330. The heater 370 may be installed inside the air-conditioning module 300 in the connection flow path 330. The heater 370 may heat the air flowing to the discharge port 342. When providing the drying air flow, warm air that has passed through the heater 370 may be discharged outward from the housing 30. For example, the air-conditioning module 300 may include a heat pump cycle that circulates a phase-changing refrigerant to cool a surface and passes air over the cooled surface space to cause moisture in the air to condensate into liquid form for collection.

Additionally, an ionizer 380 that generates ions may be installed inside the air-conditioning module 300 in the connection flow path 330. The ionizer 380 may generate ions in the air that is moving in the air-conditioning module 300 and may discharge the ions through the discharge port 342. The ions may function to disinfect the air passing through the air-conditioning module 300.

Figure 10:
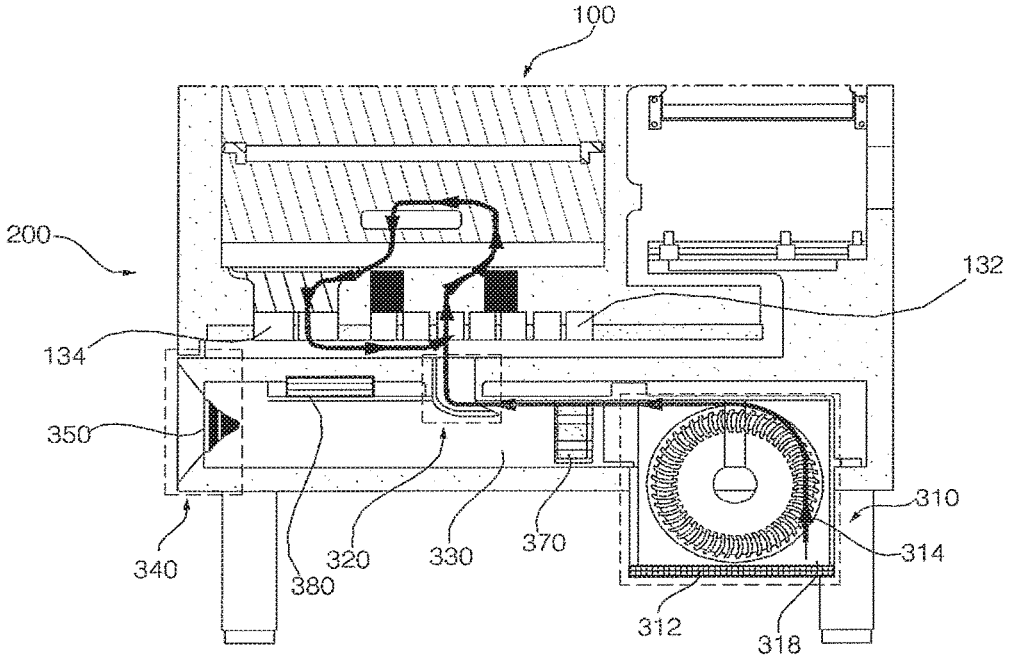
FIG. 10 is a view for explaining the flow of air when the air that has moved in the air-conditioning module moves to the module above the air-conditioning module.

In one implementation, the air-conditioning module 300 may cause air to move to the inside of the housing 30, rather than externally outputting the dried air to dry the bathroom or a user. For example, dried air may be circulated within the module case 100 when the vain 350 is positioned to block the discharge portion 340. Referring to FIG. 10, the connection flow path 330 may be formed between the suction portion 310 and the discharge portion 340 of the air-conditioning module 300. In this implementation, a communication hole 320 may be formed in the connection flow path 330 to selectively enable a movement of air to the modular space inside the housing 30, such as to output the dried air to a space above the air-conditioning module 300. The communication hole 320 may be formed in the top of the air-conditioning module 300 so as to communicate with another module 200 positioned above the air-conditioning module 300.

The air-conditioning module 300 may include includes a guide portion (or guide surface) 332, which directs the movement of air to the communication hole 320. The guide portion 332 may extend in the direction opposite the direction in which air moves in the connection flow path 330 (e.g., extending toward the suction portion 310). For example, the guide portion 332 may have an L-shaped form so as to guide the air, which moves in the connection flow path 330, toward the communication hole 320 formed in the top of the air-conditioning module 300.

The air that moves through the air-conditioning module 300 may be directed to the modular space inside the housing 30 through the communication hole 320. When a module 200 is provided in the modular space, the movement of air may be provided to the module 200 for performance of a function. For example, a module 200 may include an electronic component, such as a music player to output audio, and the air received from air conditioning module 300 may function to dry the electronic component. When no module 200 is provided in the modular space, the movement of air may function to dry the modular space and items contained therein.

Figure 11:
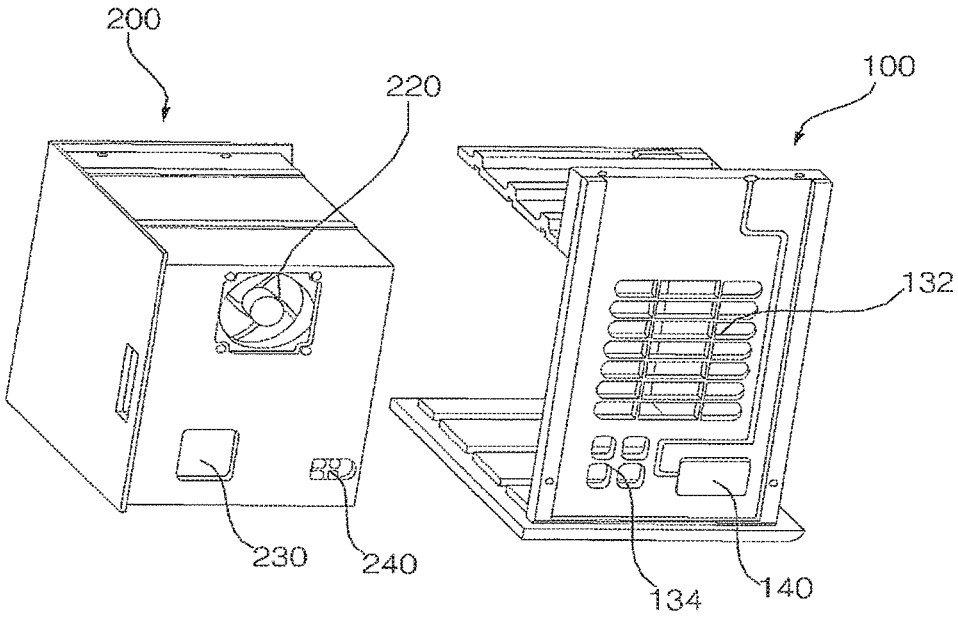
FIG. 11 is a view for explaining the module and the module case according to the embodiment of the present disclosure.

Referring to FIG. 11, the module case 100, which may accommodate a module 200 therein, may be provided inside the washstand cabinet 10, and the module case 100 may have a module suction port (or module inlet) 132 for receiving air from the air-conditioning module 300 and a module discharge port (or module outlet) 134 for outputting air. The module 200, accommodated in the module case 100, may include holes (or inlet hole) 220 and (or outlet hole) 230 formed in positions corresponding to the module suction port 132 and the module discharge port 134. The module 200 may include a fan (shown as being installed in the hole 220) for generating an air flow through the holes 220 and 230 formed therein.

As illustrated in FIG. 10, the air introduced into the suction portion 310 may be moved to the communication hole 320 via the guide portion 332. The air that has passed through the communication hole 320 may move to the inside of the module case 100 through the module suction port 132 of the module case 100. Then, the air, which has been discharged from the inside of the module case 100 through the module discharge port 134, may be mixed with air suctioned through the communication hole 320, thereby again being circulated to the inside of the module case 100.

The module 200 according to one embodiment may be a device that is electrically operated and is controlled when power is supplied from a power supply unit 140 of the module case 100 to a module power unit 240. When the module 200 is positioned in the module case 100, power may be supplied to the module 200 so as to control the module 200. When no module is accommodated in the module case 100, the space inside the module case 100 may be utilized as a general storage space.

Thus, when the module 200 is provided inside the module case 100, the movement of air to the inside of the module 200 may be performed to circulate air within the module 200. When the module 200 is not provided inside the module case 100, the movement of air inside the module case 100 may be performed to circulate air within the module case 100.

Figure 12:
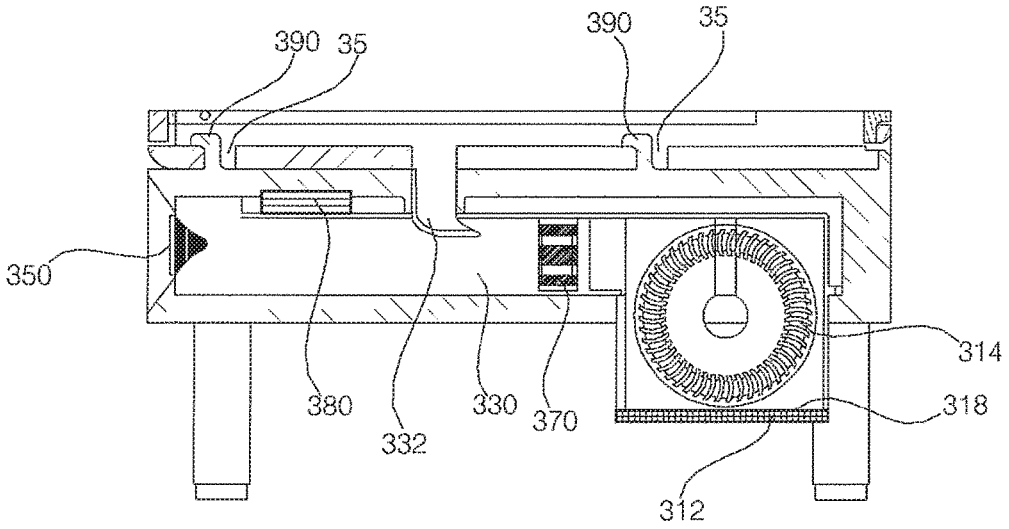
FIG. 12 is a view for explaining an air-conditioning module that is separably coupled to the washstand cabinet according to a further embodiment of the present disclosure.

FIG. 12 is a view of an air-conditioning module that is separably coupled to the washstand cabinet according to another embodiment of the present disclosure. In this other embodiment, the washstand cabinet 10 may be configured such that the air-conditioning module 300 may be separably coupled to a bottom of the housing 30 of the washstand cabinet 10.

For example, the air-conditioning module 300 may further include at least one holder (or hook) 390 provided on the top thereof. The holder 390 may allow the air-conditioning module 300 to be mounted to the bottom of the housing 30 of the washstand cabinet 10. A holder recess 35 may be formed in a horizontal surface (e.g., a bottom) of the housing 30 of the washstand cabinet 10 to receive and engage the holder 390. The air-conditioning module 300 according to this embodiment may be separably coupled as the holder 390 engages the holder recess 35 formed in the lower surface of the washstand cabinet 10. When the air-conditioning module 300 is mounted to the bottom of the washstand cabinet 10, the air-conditioning module 300 may have therein a hole or opening for the movement of air from the air-conditioning module 300 to a module (e.g., module 200) inside the housing 30.

As is apparent from the above description, a cabinet according to the present disclosure may have the following effects. First, a cabinet in which a module is accommodated may be provided under a washstand to define a storage space inside a bathroom, and an air-conditioning module may be provided inside the washstand cabinet. The air-conditioning module may function to dry the bathroom and/or a user's body. Second, the air-conditioning module inside the washstand cabinet may be connected to a modular space inside the washstand cabinet, thereby serving to dry the modular space. Third, even when an electrically-operated module is provided inside the washstand cabinet, air may be moved to the module so as to dry the inside of the module.

An aspect of the present disclosure utilizes the space under a washstand as a washstand cabinet and to dry the air in a bathroom or dry the human body using the washstand cabinet. Another aspect of the present disclosure moves air to the space inside a washstand cabinet or a module provided inside the washstand cabinet.

To dry a bathroom in accordance with one aspect of the present disclosure, a washstand cabinet may include an air-conditioning module provided therein to discharge dry air outward, wherein the air-conditioning module may include a vane or cover configured to selectively discharge the air upward or downward from a discharge port of the air-conditioning module. To achieve the function of moving air into a module, in accordance with another aspect of the present disclosure, there is provided a washstand cabinet including a hole configured to permit an air-conditioning module provided inside the washstand cabinet to communicate with a space inside the washstand cabinet or a module provided inside the washstand cabinet so as to move air to the space or the module inside the washstand cabinet.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washstand cabinet comprising:

a washstand coupled to a water supply valve and having a washing bowl in which water is accommodated;

a housing provided under the washstand to define an external shape thereof and having a space therein; and a dryer provided under the housing and spaced apart from the floor and configured to at least one of discharge air in a forward direction of the washstand cabinet or discharge air into the space of the housing, wherein the dryer includes:

a suction port opened to a lower side of the washstand cabinet and into which air is input;

a fan configured to suction air into the suction port;

a discharge port opened frontward to discharge air inside of the dryer; and a vane that opens or closes the discharge port or vertically adjusts air discharged from the discharge port, wherein the dryer further includes a connection flow path to connect the suction port and the discharge port, and a communication hole positioned for air communication between the space in the housing and the connection flow path, and wherein the connection flow path includes a guide surface to guide air input from the suction port to the communication hole.

2. The washstand cabinet according to claim 1, wherein the dryer includes:

a filter positioned in the suction port and configured to remove particles from air introduced into the dryer; and a heater positioned in the connection flow path and configured to heat air flowing through the connection flow path.

3. The washstand cabinet according to claim 1, wherein the dryer includes:

an ionizer positioned in the connection flow path and configured to generate ions inserted in air to be discharged from the discharge port.

4. The washstand cabinet according to claim 1, wherein the vane includes:

a front vane provided in the discharge port to guide the direction in which the air is discharged;

a rear vane rearwardly spaced apart from the front vane and extending parallel to the front vane; and one or more ribs configured to connect the front vane and the rear vane, and wherein the vane has a guide hole formed between the front vane and the rear vane to guide the air to the discharge port.

5. The washstand cabinet according to claim 4, wherein the dryer further includes a motor connected to a side surface of the vane and configured to rotate the vane.

6. The washstand cabinet according to claim 5, wherein the vane further includes side surfaces formed on opposite ends of the front vane and the rear vane, and wherein each of the side surfaces has a rotating shaft formed at a rear side adjacent to the rear vane, the vane being rotated around the rotating shaft.

7. The washstand cabinet according to claim 1, wherein the vane includes an upper vane configured to cover an upper portion of the discharge port and a lower vane configured to cover a lower portion of the discharge port, and wherein the upper vane and the lower vane are movable relative to each other at a connection portion thereof.

8. The washstand cabinet according to claim 1, wherein the guide surface extends in a direction opposite a direction of a flow of air in the connection flow path.

9. The washstand cabinet according to claim 1, wherein the housing includes a module case configured to divide the space inside the housing into two or more spaces, and wherein the module case has a module suction port into which air is introduced from the dryer.

10. The washstand cabinet according to claim 9, wherein at least one module is accommodated in the module case, and wherein the module has a communication hole formed therein at a position corresponding to the module suction port.

11. The washstand cabinet according to claim 1, wherein the dryer is configured to be separable from a horizontal surface of the housing.

12. The washstand cabinet according to claim 11, wherein the horizontal surface of the housing is provided with a holder recess, and the dryer is provided on a top thereof with a hook that is received in the holder recess to releasably mount the dryer to the horizontal surface of the housing.

13. A cabinet comprising:

a housing provided under a basin to accommodate water;

a module case provided inside the housing; and a dryer provided under the modular case and to generate an air flow, wherein the dryer includes:

a suction port opened to a lower side of the cabinet and into which air is input;

a fan configured to suction air through the suction port;

a discharge port opened frontward to communicate with an exterior of the cabinet;

a communication hole in communications with the module case; and a vane positioned at the discharge port of the dryer and that opens or closes the discharge port or vertically adjusts air discharged from the discharge port, wherein dryer outputs the air flow to the exterior of the cabinet when the vane is moved to expose at least a portion of the discharge port, wherein the dryer further includes a connection flow path to connect the suction port and the discharge port, and the communication hole positioned such that an inside of the module case communicates with the connection flow path, and wherein the connection flow path includes a guide surface that guides air input from the suction port to the communication hole.

14. The cabinet of claim 13, further comprising:

a motor configured to move the vane between a first position where the vane blocks the discharge port and at least one of a second position where an upper portion of the discharge port is exposed or a third position where a lower portion of the discharge port is exposed.

15. The cabinet of claim 14, wherein the vane includes an upper vane positioned in the upper portion of the discharge port and a lower vane positioned in the lower portion of the discharge port, and wherein motor moves the upper vane to cause the dryer to output the air flow in an upward direction, moves the lower vane to cause the dryer to output the air flow in a downward direction, or moves both the upper and lower vanes to cause the dryer to output the air flow in both the upward and downward directions.

16. The cabinet of claim 13, wherein the dryer includes:

a heater to warm the air flow.

* * * * *